US006914532B2

(12) United States Patent
Crooks et al.

(10) Patent No.: US 6,914,532 B2
(45) Date of Patent: Jul. 5, 2005

(54) METHOD AND APPARATUS FOR ALARM VERIFICATION IN A VENTILATION SYSTEM

(75) Inventors: Kenneth William Crooks, Groton, MA (US); Andrew Smith, Needham, MA (US)

(73) Assignee: Honeywell International Inc., Morristown, NJ (US)

( * ) Notice: Subject to any disclaimer, the term of this patent is extended or adjusted under 35 U.S.C. 154(b) by 103 days.

(21) Appl. No.: 10/630,093

(22) Filed: Jul. 30, 2003

(65) Prior Publication Data

US 2005/0024216 A1 Feb. 3, 2005

(51) Int. Cl.[7] ..... G08B 21/00

(52) U.S. Cl. ..... 340/606; 340/632; 340/506; 340/514; 340/515

(58) Field of Search ..... 340/606, 607, 340/608, 609, 610, 632, 506, 514, 515, 522; 454/236, 255; 700/11; 62/92

(56) References Cited

U.S. PATENT DOCUMENTS

| | | | | |
|---|---|---|---|---|
| 4,098,174 A | | 7/1978 | Landy | |
| 4,245,779 A | * | 1/1981 | Ardiente | 236/1 G |
| 4,466,341 A | | 8/1984 | Grogan | |
| 4,497,242 A | | 2/1985 | Moyer | |
| 4,528,898 A | | 7/1985 | Sharp et al. | |
| 4,706,553 A | | 11/1987 | Sharp et al. | |
| 4,934,256 A | | 6/1990 | Moss et al. | |
| 5,014,541 A | | 5/1991 | Sides et al. | |
| 5,090,303 A | | 2/1992 | Ahmed | |
| 5,092,227 A | | 3/1992 | Ahmed et al. | |
| 5,115,728 A | | 5/1992 | Ahmed et al. | |
| 5,170,673 A | | 12/1992 | Ahmed et al. | |
| 5,215,497 A | | 6/1993 | Drees | |
| 5,240,455 A | | 8/1993 | Sharp | |
| 5,470,275 A | | 11/1995 | Jacob et al. | |
| 5,475,364 A | * | 12/1995 | Kenet | 340/522 |
| 5,562,537 A | | 10/1996 | Zver et al. | |
| 5,697,838 A | | 12/1997 | Morris | |
| 5,733,188 A | | 3/1998 | Jacob | |
| 5,764,579 A | | 6/1998 | McMasters et al. | |
| 5,798,697 A | | 8/1998 | Wiseman | |
| 5,882,254 A | | 3/1999 | Jacob | |
| 5,951,394 A | | 9/1999 | Pariseau | |
| 6,081,196 A | * | 6/2000 | Young | 340/606 |
| 6,131,463 A | | 10/2000 | Morris | |
| 6,272,399 B1 | | 8/2001 | Fish, Jr. et al. | |
| 6,357,393 B1 | | 3/2002 | Coiro, Sr. et al. | |
| 6,425,297 B1 | | 7/2002 | Sharp | |

* cited by examiner

*Primary Examiner*—Van T. Trieu
(74) *Attorney, Agent, or Firm*—Gregory M. Ansems

(57) ABSTRACT

Method and apparatus for testing the operation of an alarm for a ventilated enclosure, such as a fume hood or bio-safety cabinet. Flow of gas being exhausted from the enclosure may be adjusted to a known value below or above a threshold value at which the alarm provides an indication that flow is unacceptably low or high. Adjustment of flow to the known value may be performed without requiring a manual measurement of flow, e.g., by performing a traverse in a duct leading from the enclosure.

34 Claims, 2 Drawing Sheets

METHOD AND APPARATUS FOR ALARM VERIFICATION IN A VENTILATION SYSTEM

BACKGROUND OF INVENTION

1. Field of Invention

This invention relates to alarm verification in ventilation systems, such as laboratory fume hoods and other ventilated enclosures.

2. Related Art

In laboratory settings, such as chemical, biological, biotechnological, or semiconductor laboratories, a need commonly exists for exhausting air from portions of a laboratory. For example, harmful or offensive chemicals may be used or otherwise present in the laboratory or created by live animals or other organisms. These offensive or harmful materials are commonly vented using a laboratory fume hood or other vented enclosure, such as a bio-safety cabinet.

Fume hoods and other ventilated enclosures are commercially available in a wide variety of types and with control systems to provide desired venting characteristics. For example, some fume hoods incorporate movable doors, or sashes, that a user can move to adjust the size of an access opening of the fume hood. Fume hood control systems are available that adjust the amount of air vented from the fume hood based on the size of the sash opening, e.g., to maintain a constant face velocity of air being drawn into the hood at the opening. As is well understood in the art, maintaining a relatively constant face velocity as the sash opening size changes can be important to ensuring that materials in the fume hood do not escape through the sash opening. As a result, as the size of the sash opening increases, the volume flow rate of air exhausted from the hood may be increased to maintain a desired face velocity. Likewise, if the sash opening size is decreased, the volume flow rate may be decreased to maintain the same face velocity at the opening.

In other arrangements, such as bio-safety cabinets, animals or other organisms may be kept inside a cabinet that has no movable sash or variable size opening. In such arrangements, a constant volume of air may be exhausted from the cabinet since no adjustment in flow rate is typically needed to accommodate a fixed size sash opening.

One other feature that is common in some types of fume hoods or other ventilated enclosures is that an alarm is arranged to provide an audible and/or visual signal or otherwise indicate to a user that an inadequate amount of air is being exhausted from the enclosure. These alarms may be arranged in a variety of different ways and be activated based on signals from a variety of different types of sensors. In one embodiment, an alarm may be activated in situations where a volume flow rate exhausted from the enclosure drops below 20% of a desired flow rate. In other arrangements, an alarm may be activated in situations where a volume flow rate is too high above a desired flow rate.

SUMMARY OF INVENTION

The inventors have appreciated that it may be desirable to provide an alarm verification system by which the proper operation of an alarm system for a ventilated enclosure can be verified.

In one common arrangement, the proper operation of an alarm is verified by manually adjusting a flow of air being exhausted from an enclosure until the flow is reduced to an alarm threshold flow, i.e., a flow at which the alarm is activated. In some ventilated enclosures, the alarm threshold flow may be a flow at or below 80% of a desired setpoint flow rate, where the setpoint flow rate is a flow at which air is exhausted from the enclosure under normal operating conditions. Adjusting the exhaust flow to the alarm threshold flow is difficult in many systems because an operator must manually measure the flow from the enclosure using a hand-held sensor after manual adjustment of a damper or other flow control element. Since the initial adjustment to the flow usually does not result in an accurate adjustment to the threshold flow, an operator must perform multiple flow adjustment/measurement steps to properly set the flow at the alarm threshold. Thus, adjusting the flow to the alarm threshold usually requires an iterative process by which the operator makes a manual adjustment to reduce flow, e.g., by adjusting the position of a damper, followed by a manual measurement of the actual flow to determine whether the flow has been set at the alarm threshold, e.g., by a manual traverse in the duct, followed by yet another flow adjustment, another manual measurement, and so on until the flow is finally set appropriately below or above the alarm threshold. Once alarm activation is verified at a suitable flow, flow exiting the enclosure must again be set back at the desired setpoint flow rate by another iterative process of flow adjustment, followed by manual measurement, readjustment of the flow, measurement, etc. until the desired setpoint is achieved.

In one aspect of the invention, a system and method is provided that allows for alarm verification without requiring manual measurement of flow. In one illustrative embodiment, an alarm verification system may automatically adjust a flow of air being exhausted from an enclosure to a value below or above an alarm threshold value at which an alarm is activated. Such an arrangement may allow for rapid verification that an alarm system is operating properly, while also ensuring that the alarm operation is verified at the proper flow rate. In arrangements that require manual measurement to set flow to a threshold value and verify an alarm's operation, an operator may mistakenly set the flow for verification at a value that is far lower, or higher, than the threshold value. For example, while a test of an alarm system may be required to verify that the alarm is activated for flows at 80 to 75% of a desired setpoint flow, a human operator may mistakenly test the alarm operation at a flow that is 75% or lower than the setpoint flow rate. Such an erroneous setting may mistakenly indicate that the alarm is operating properly while, in fact, the alarm may not activate for flows in the 80 to 75% range.

In one aspect of the invention, an apparatus for verifying operation of an alarm in a vented enclosure laboratory enclosure includes an enclosure from which gas may be exhausted, and a flow control device that controls a flow rate of gas removed from the enclosure. An alarm may provide an indication when a flow rate of gas being removed from the enclosure is below or above a threshold flow rate An alarm verification device, in response to user input to test operation of the alarm, may cause a signal that the flow rate of gas being removed from the enclosure is below or above the threshold flow rate. Such a signal may be the result of an actual change in flow to below or above the threshold flow rate, or may indicate such a flow condition when in fact actual flow has not been changed at all.

In one aspect of the invention, the alarm verification device causes an actual change in the flow rate of gas being removed from the enclosure to a known value below or above the threshold flow rate in response to user input to test operation of the alarm.

In another aspect of the invention, the alarm verification device changes the flow rate to the known value without requiring actual measurement of flow.

In another aspect of the invention, the alarm verification device changes the flow rate to the known value without requiring manual measurement of a flow of gas removed from the enclosure.

In another aspect of the invention, an apparatus for verifying operation of an alarm in a vented enclosure laboratory enclosure includes a flow control device adapted to control a flow rate of gas flowing through a conduit from a vented enclosure. An alarm verification device is adapted to cause, in response to input from a user to test an alarm, generation of a signal that indicates the flow rate through the conduit is less than or greater than the threshold flow rate. A flow through the conduit of a value below or above the threshold flow rate causes an alarm to be activated, if it is operating normally.

In another aspect of the invention, an air flow control apparatus includes a damper element movable in a conduit to adjust a flow of gas through the conduit, and a controller arranged to control a position of the damper element to maintain flow through the conduit at a setpoint value. An alarm verification device is arranged to override control of the damper position by the controller and position the damper element to set air flow through the conduit at a known value that is equal to or less than a threshold value. Flow below or above the threshold value is less than the setpoint and causes an alarm to be activated. Thus, proper operation of the alarm may be verified by setting flow at the known value.

In another aspect of the invention, a method for verifying the operation of an alarm for a ventilated enclosure includes providing an enclosure from which gas may be exhausted, and providing a flow control device that normally controls a flow rate of gas removed from the enclosure to a setpoint value. An alarm is provided that gives an indication when a flow rate of gas being removed from the enclosure is below or above a threshold flow rate. A flow rate of gas being removed from the enclosure is adjusted to a known value below or above a threshold flow rate without manually measuring air flow to test the alarm.

These and other aspects of the invention will be apparent and/or obvious from the following detailed description.

BRIEF DESCRIPTION OF DRAWINGS

Illustrative embodiments in accordance with the invention are described below with reference to the following drawings. The drawings, which are not to scale, include reference numerals which refer to like elements, and wherein.

DETAILED DESCRIPTION

Figure 1:
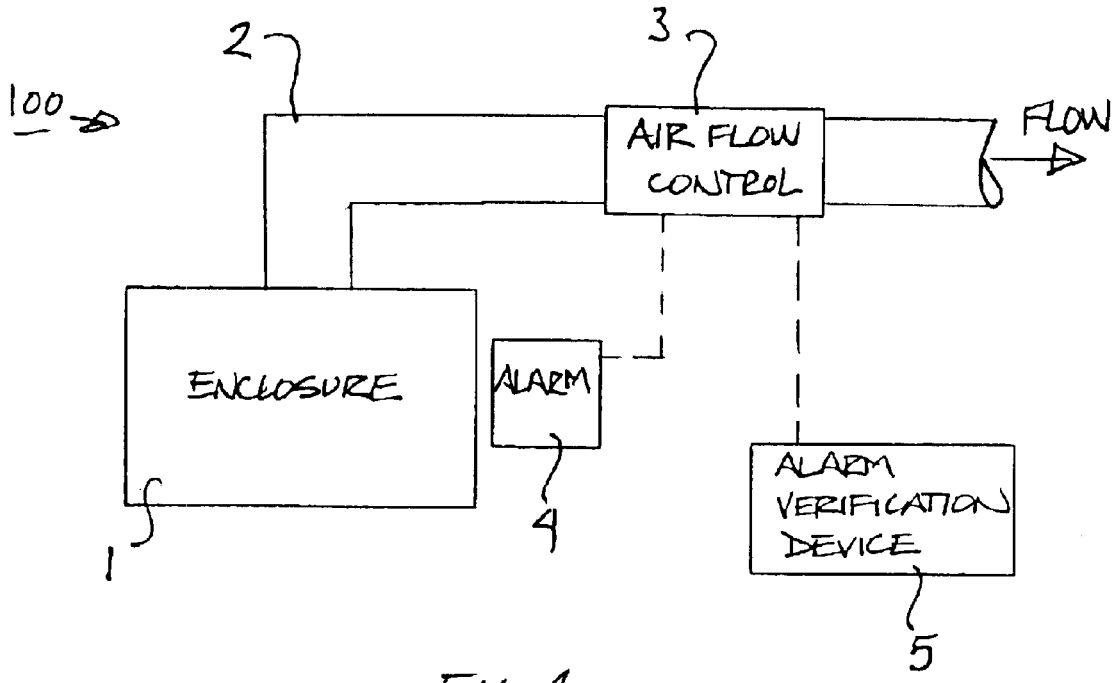
FIG. 1 is an illustrative embodiment of a ventilation system including an alarm verification system in accordance with the invention.

Various aspects of the invention are illustratively described below in connection with different embodiments. However, it should be understood that aspects of the invention are not to be limited to the specific embodiments described herein, but instead, may be used in any suitable arrangement. For example, the embodiments below include only one illustrated enclosure, but aspects of the invention may be used with two or more enclosures that share a common blower, common ductwork or any other system that exhausts gas from the enclosures. In such systems, flow from each of the enclosures may be individually controlled by a damper or other air flow control linked to a conduit leading from the enclosure. In addition, the terms "air" and "gas" are used interchangeably herein, and are intended to both refer to a generally gaseous material that is exhausted from an enclosure, regardless of whether the material has the composition of normal air (e.g., 80% nitrogen, etc.) or includes some solid or liquid particles (such as dust, liquid droplets, etc.).

In one aspect of the invention, the operation of an alarm associated with a vented enclosure may be verified by use of a verification device to set a flow of gas exhausted from the enclosure to a known value that is less than or greater than a threshold value at which the alarm is activated. By "known value", it is meant that flow may be accurately set to a particular value or within a particular range of values without requiring manual measurement of flow at the time of adjustment. As a result, no manual measurement of air flow exhausted from the enclosure need be performed to assure that flow has been properly set when verifying an alarm's operation. In one embodiment, the known value at which the verification system sets the flow for verification purposes may be accurately calibrated before the air flow control system is put into service. For example, with a damper to be used in a constant volume application such as a bio-safety cabinet, the positions of a restriction element of a damper that provide (1) a setpoint flow for normal operation, and (2) a flow below or above an alarm threshold value may be determined at the factory when the damper is manufactured. When the damper is installed in the field, an operator may readily set the position of the flow restriction element for either normal operation at the setpoint value or for alarm verification to provide a flow below or above the threshold value.

In one aspect of the invention, the verification device may include a sensor that indicates a position of the flow restriction element used to adjust flow to the alarm threshold value, and a display that provides an indication, either directly or indirectly, of the flow being provided by the flow restriction element. The display may therefore aid in assuring that flow has been appropriately set below or above a suitable threshold value, or aid in resetting flow to a desired setpoint after alarm verification. The display may indicate an actually measured volume flow rate (e.g., in cubic feet per minute or CFM), a flow rate induced from a determined position of a restriction element or blower speed, a position of a restriction element, or other information indicative of the flow of gas being exhausted from the enclosure.

In another aspect of the invention, the verification device may automatically adjust flow to a known value by overriding control in the air flow control or by control of a separate air flow control device. For example, when verifying the operation of an alarm, the verification device may override control signals sent to an automatically-controlled damper to adjust a flow restrictor in the damper to provide flow below or above the alarm threshold value. Since the air flow control has not changed the flow setpoint, a normally operating alarm will be activated. (Adjusting flow to a reduced rate using the air flow control will typically adjust the setpoint established by the air flow control. As a result of the reduced flow setpoint established by the air flow control, a low flow alarm typically will not be activated.) Alternately, the verification device may adjust flow using a separate device, such as a separate damper, without overriding control signals of the air flow control.

In another illustrative embodiment, the alarm verification device may provide a signal to test alarm activation without actually changing flow from the enclosure at all. For example, an alarm verification device may provide a signal to an alarm that is substituted for a signal normally sent to the alarm from an air flow sensor or other device that provides an indication of the flow being exhausted from an enclosure (whether by blower speed, damper position, measured air flow, measured pressure drop, etc.). The substituted signal from the alarm verification device may cause a normally operating alarm to be activated, indicating a low flow condition or high flow condition when in fact actual flow has not been changed. The signal from the alarm verification device may take other forms, such as a signal that changes the way in which the alarm determines whether a low (or high) flow condition is present or not (e.g., a signal to the alarm that indicates a setpoint flow above the actual flow or that changes the algorithm used by the alarm).

FIG. 1 shows a schematic block diagram of a ventilation system 100 in accordance with the invention. In this illustrative embodiment, the system 100 includes an enclosure 1 within which harmful and/or offensive fumes or other materials may be generated. The enclosure 1 may take any suitable form, such as a cabinet, room, fume hood, or other enclosed or semi-enclosed space. The enclosure 1 may incorporate movable doors or sashes (not shown) to allow access into the interior of the enclosure 1. The enclosure 1 may be arranged in any suitable way for conducting any suitable work, such as chemical experiments, housing laboratory animals (e.g., a vivarium), or other uses.

Gas within the enclosure 1 may be exhausted via a conduit 2 and an air flow control 3. The air flow control 3 may include any suitable components to control a volume flow rate of air exhausted from the enclosure 1. For example, the air flow control 3 may include a blower or other air moving device, a damper, vanes or other air flow restrictor, or other suitable devices to move or otherwise control flow of air in the conduit 2. The air flow control 3 may also include other components to aid in the control of flow, such as pressure sensing devices, air flow sensors, blower speed indicators, damper position indicators, or other devices. The air flow control 3 may provide a constant volume flow of air through the conduit 2, or may provide a varying flow. A constant volume flow is typically suitable for applications in which the enclosure 1 does not include movable sashes or doors, or where access to the enclosure 1 is limited or restricted. Variable volume flow control may be suitable for applications in which the enclosure 1 includes movable sashes or otherwise has a variable size opening, where flow is increased during times of high activity in the enclosure 1, where flow is decreased during times of low or no activity in the enclosure 1, where flow is increased for emergency situations (such as accidental spills or a fire), etc. Such air flow control, as well as the devices and systems used to control flow, are well-known in the art.

The air flow control 3 may also include a controller to perform the necessary signal processing, computations, and other input/output functions to control the operation of devices in the air flow control 3. The controller may include a programmed computer, analog circuitry or other suitable devices, as well as user interfaces, such as visual displays, touch pads, control buttons, and switches, and other devices to receive input from a user and provide operating conditions or other information. The controller may also include sash sensors or other devices to detect the position of movable sashes in the enclosure 1 or otherwise detect the size of an opening on the enclosure 1. The controller may use this information to control the flow of gas exhausted from the enclosure 1, as is known in the art. The controller may also include other devices to control flow, such as video cameras, pressure sensors, or other devices to detect the presence of a human near the enclosure 1, or other parameters that may affect air flow control. Since the various components in and operations of the different types of air flow control apparatuses that may be used to ventilate an enclosure are well known in the art, further details regarding such systems are not provided herein.

In this illustrative embodiment, an alarm 4 is provided to indicate when air flow exhausted from the enclosure 1 is below or above a threshold level. For example, in constant flow systems, air flow may be set at a constant setpoint value, e.g., 1000 cubic feet per minute (CFM). If the air flow drops below a threshold value, such as 80% of the setpoint value, the alarm 4 may provide a visual and/or audible indication that air flow is unsuitably below the desired setpoint. Of course, the threshold value at which the alarm is activated may be any suitable percentage of the setpoint air flow, such as 120% of the setpoint, 70% of the setpoint, or any other value below or above the setpoint flow rate.

In variable flow control systems, the setpoint is typically adjusted between two or more different flow rates, e.g., to accommodate changing sash opening sizes, reduced or non-use of the enclosure, or other parameters. In this case, the threshold value at which the alarm 4 is activated may also change. For example, a fume hood air flow control system may operate to maintain a constant face velocity at a sash opening. Thus, as the sash opening is enlarged, the air flow control may suitably increase the flow rate setpoint so that the desired face velocity at the sash opening is maintained. In this case, the threshold value at which the alarm 4 is activated may change with the changing setpoint value for flow. For example, the alarm 4 may be set to activate for flows at or below 80% of the setpoint. For a setpoint of 1000 CFM, the alarm may be activated at flows of 800 CFM or less. However, if the setpoint is adjusted to 1200 CFM to account for an enlarged sash opening, the alarm 4 may be activated for flow rates at or below 960 CFM.

Normal activation of the alarm 4 may be based on any suitable parameter. For example, an indication that the desired flow has dropped below (or raised above) a threshold level may be provided based on a detected pressure drop in the conduit 2, a measured air flow in the conduit 2, a detected position of an air flow restrictor in a damper, a blower fan speed, a measured face velocity at a sash opening, or any other suitable parameter or set of parameters. For example the alarm 4 may be activated based on two or more parameters, such as a position of a damper that indirectly indicates flow through the conduit, and a pressure differential detected in the conduit that directly indicates whether a suitable flow rate is present across a flow restrictor. The setpoint used to determine whether to activate the alarm may be received in the form of a signal from the air flow control, or may be stored in a memory of the alarm.

In this embodiment, proper operation of the alarm 4 may be verified using an alarm verification device 5. In one embodiment, the alarm verification device 5 may be used to change the flow rate of air being removed from the enclosure 1 to a known value below or above the threshold flow rate at which the alarm is activated. User input to the alarm verification device 5 to test the operation of the alarm 4 may take any suitable form. The alarm verification device 5 may be actuated manually by an operator to adjust the flow rate, or may adjust the flow rate in an automated way in response to a user pressing a button. For example, the alarm verification device 5 may include a mechanical actuator (e.g., a lever and associated mechanical linkage) that can be manually manipulated by an operator to adjust flow to a known value. Such manual manipulation may adjust a position of a flow restrictor in a damper or other element to reduce flow in the conduit 2. Alternately, a user may press button or turn a key switch that causes the alarm verification device 5 to automatically test the operation of the alarm without further user input. The alarm verification device 5 may include a damper or other flow restriction device separate and apart from the air flow control 3. Alternately, the alarm verification device 5 may control the operation of a flow restrictor or other device in the air flow control 3 to adjust flow. The alarm verification device 5 may provide a signal to the air flow control 3 that overrides a normal operating signal and causes a damper, blower, or other device to create flow at the desired threshold value. Such override may cause a blower to produce a reduced flow (e.g., run at a slower speed), or move a damper element to restrict flow to a value below the setpoint. The flow set by the alarm verification device 5 may cause the flow in the conduit 2 to be set at a known value below or above the threshold value at which the alarm 4 is activated.

Although the alarm verification device may allow for flow adjustment to a known value to test the operation of an alarm without any display, the alarm verification device 5 may include a display that provides an indication of the current flow in the conduit 2. The display may indicate the flow directly, such as by indicating a volume flow rate or face velocity at a sash opening, or indirectly, such as by indicating a position of a flow restrictor in a damper, a detected air speed, a detected pressure differential, or in other ways. Such a display may be helpful to provide an indication that the system is in alarm verification mode. In addition, such a display may be useful in embodiments where the alarm verification device 5 includes a manual activation element by which an operator manually adjusts the flow relative to the alarm threshold value. The display of such information by the alarm verification device 5 can thus avoid any need for an operator to perform a manual measurement of flow being exhausted from the enclosure 1, such as by a manual traverse in the conduit 2 and/or at the sash opening of the enclosure 1.

In one aspect of the invention, the alarm verification device 5 may adjust flow of air being exhausted from the enclosure 1 to a known value without requiring actual measurement of flow in the conduit 2 or elsewhere. For example, in an embodiment in which the flow control 3 includes a pressure-independent damper, such as one of the types manufactured by Phoenix Controls of Acton, Mass., the damper may be calibrated at the factory such that the positions of the flow restrictor at which particular flow rates are provided are empirically determined and used to configure the alarm verification device 5. For example, a first position of the flow restrictor may provide a setpoint flow rate for a constant velocity application, whereas a second position of the flow restrictor may provide a flow rate approximately equal to a threshold value at which an alarm 4 should be activated. These positions may be noted and used by the alarm verification system 5, e.g., incorporated into a mechanical linkage used to position the flow restrictor at one or more precise locations, stored in a memory or incorporated into an algorithm used to generate a display that indicates when flow is below or above the threshold value. When the damper is installed in the field, an operator may readily position the restrictor element at the normal operating position to provide the constant flow required for the application, e.g., using a display of the alarm verification system 5 that indicates when flow is established at a desired setpoint. However, upon a need to verify the operation of the alarm 4, such as during a yearly certification of a bio-safety cabinet, an operator may readily adjust the restrictor element position to provide the reduced flow at the threshold value, again using the display of the alarm verification device 5. Once the proper operation of the alarm has been verified, the operator may again return the restrictor element to its normal operating position.

In another illustrative embodiment, the alarm verification device 5 may provide a signal to the alarm that causes the alarm, when operating properly, to be activated without actually adjusting flow from the enclosure. For example, the alarm 4 may be activated based on an actual air flow measured in the conduit. The alarm may compare a setpoint flow to the measured flow, and if the flow deviates sufficiently from the setpoint, activate the alarm. The alarm verification device 5 may provide a signal to the alarm that is substituted for, or otherwise overrides, the signal from the air flow sensor and indicates to the alarm that flow is below or above a threshold level (whether or not this is actually the case). Alternately, the alarm verification device 5 may provide a signal that changes the setpoint used by the alarm to determine whether to activate. Using the substitute or override signal, a normally-operating alarm may be activated. Thus, in this arrangement, actual adjustment of the flow is not necessary to test the operation of the alarm.

Figure 2:
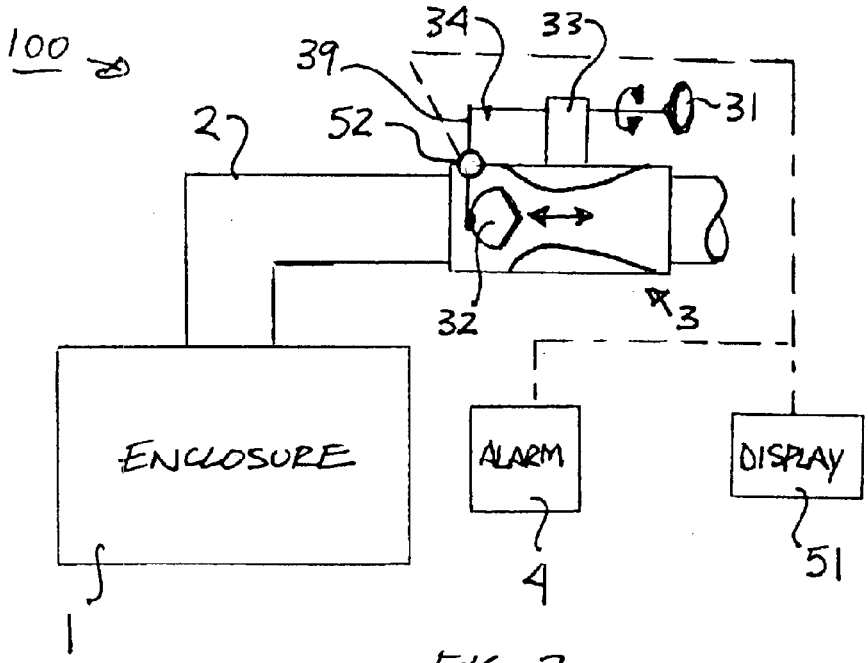
FIG. 2 is another illustrative embodiment of a ventilation system including an alarm verification system with manual flow adjustment in accordance with the invention.

FIG. 2 shows another illustrative embodiment of a ventilation system 100 in accordance with the invention. In this illustrative embodiment, the air flow control 3 includes a damper having a flow restrictor element 32 that establishes a flow rate for air being exhausted from the enclosure 1. As is well known in the art, flow through the damper may be adjusted by moving the restrictor element 32 relative to a narrowed portion of the duct. The position of the restrictor element 32 may be adjusted in this illustrative embodiment by rotating a threaded shaft 34 by a hand wheel 31. Rotating the shaft 34 causes it to move left or right relative to a bracket 33 that is threadedly engaged with the shaft 34 and is fixed to the conduit. Left or right linear movement of the threaded rod 34 drives a link 39 to pivot at or near a sensor 52 and move the restrictor element 32 left or right in the damper. The sensor 52, which may be part of the verification device 5, may detect the rotary position of the link 39 and thus, the position of the flow restrictor element 32 in the damper. Although the sensor 52 may be any suitable type of sensor, in this embodiment the sensor 52 is a potentiometer that outputs a variable resistance as the link 39 rotates. Of course, it should be understood that the position of the restrictor element 32 may be detected in any other suitable way, such as by a position encoder, an optical detection device (e.g., a video camera), detecting a position of the threaded rod 34, or other arrangements. Moreover, although the connection between the link 39 and the restrictor element 32 is shown in a simple, schematic manner, the restrictor element 32 may, in fact, be slidably mounted to a rod aligned axially along the direction of flow to provide a pressure-independent damping function. As is known in the art, the restrictor element 32 may have a spring-loaded or other biased mount to the axial rod so that as a pressure drop across the damper decreases, the restrictor element may move to increase the opening size of the damper and maintain a constant, pressure-independent flow rate. In this arrangement, movement of the link 39 may move the rod, thereby adjusting the restrictor element position. Positioning of the restrictor element to provide a desired flow may also be determined by a mechanical stop that positions the link 39 appropriately to provide a flow at a known value for alarm verification. For example, the shaft 34 may be rotated until the link 39 rests against a stop at which flow for verifying alarm activation is provided. Another stop may be provided for flow at a normal setpoint value.

A signal output by the sensor 52 may be provided to a display 51, which may also be part of the verification device 5. Based on this signal, the display 51 may provide an indication of the current flow through the air flow control 3, whether by a volume flow rate, a face velocity, a restrictor element position, as a percentage flow of a normal setpoint value, and so on. Thus, the display 51 may include electronic circuitry to effectively convert the signal provided by the sensor 52 to one or more signals that cause a meaningful visual indication to be presented on the display 51. The information may be displayed in any form, such as in alphanumeric or graphical form, or by one or more indicator lights (e.g., LEDs). In one embodiment, the display may include one light that illuminates to indicate that the air flow control 3 is currently set at a normal operation setpoint, and another light that illuminates to indicate that the air flow is set to a threshold value at which a normally operating alarm should be activated. The display 51 may be located in any suitable location or locations, such as at an access opening for the enclosure 1, immediately adjacent the damper (e.g., so an operator can view the display 51 while adjusting flow to a desired value), etc. In one embodiment, the display 51 may be part of a wireless, hand-held device, such as a personal digital assistant (PDA). In this embodiment, the PDA may receive a wireless signal from the sensor 52 or other portion of the verification device 5 (e.g., another wireless communication device), causing it to display an indication of the current flow being exhausted from the enclosure 1. Accordingly, the display 51, sensor 52 and other optional components may function together as an alarm verification device 5.

In the illustrative embodiment of FIG. 2, the alarm 4 also receives a signal from the sensor 52 and operates to provide an indication when flow is below or above a specified threshold value, such as 80% or less of a normal setpoint value, based on the position of the restrictor element 32. However, it should be understood that the alarm 4 may be activated based on parameters detected by other types of sensors, such as one or more pressure sensors that detects a pressure drop across a damper, an air velocity sensor in the conduit 2 or other portion of the system 100, a face velocity detector, and so on.

Figure 3:
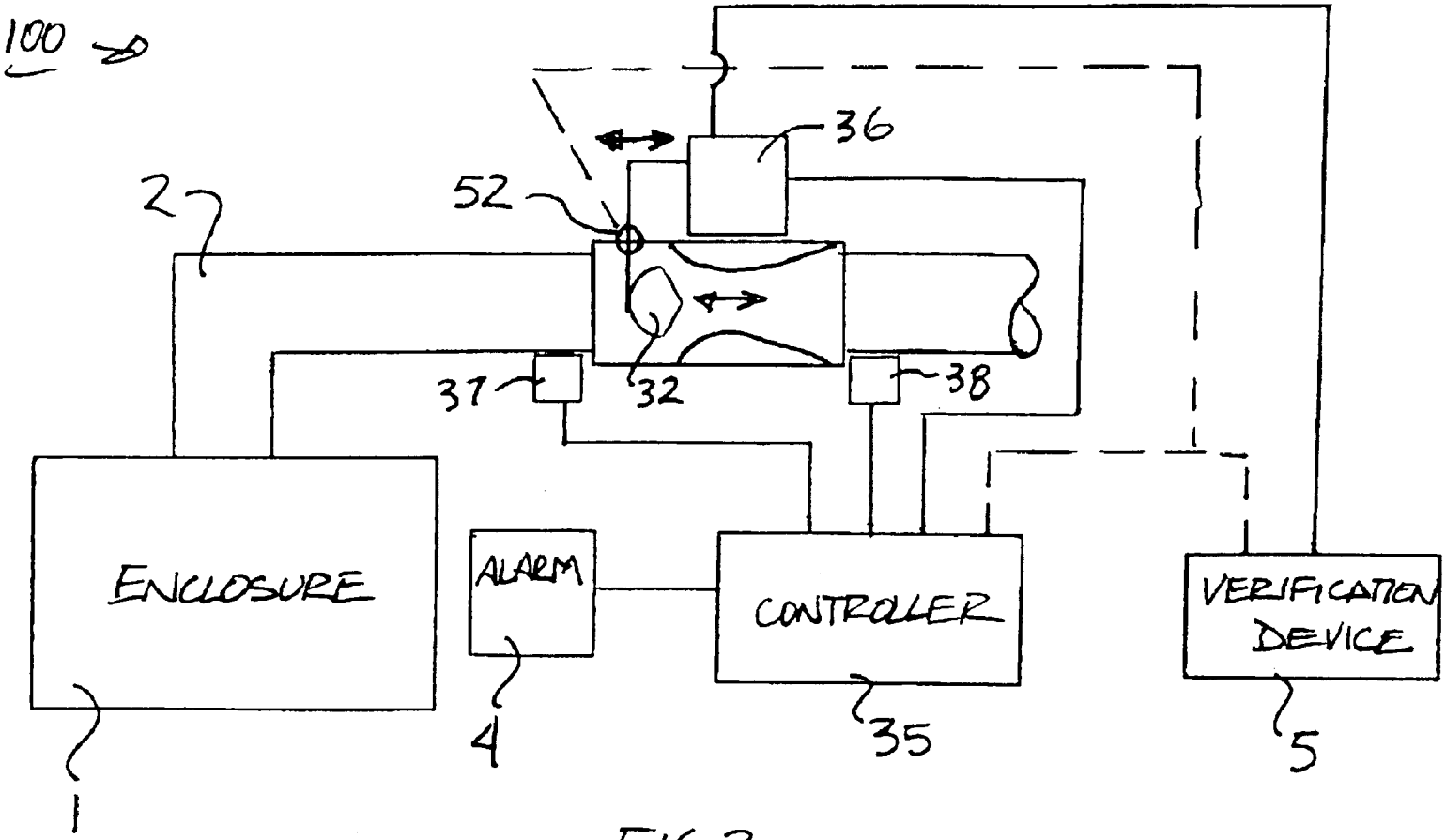
FIG. 3 is yet another illustrative embodiment of a ventilation system including an alarm verification system with automated flow adjustment in accordance with the invention.

FIG. 3 shows another illustrative embodiment of a ventilation system 100 in accordance with the invention. This embodiment is similar to the FIG. 2 embodiment, except that control of flow exhausted from the enclosure 1 may be automatically controlled. That is, the air flow control 3 may include a flow restrictor 32 in a damper like that in the FIG. 2 embodiment, but the position of the flow restrictor 32 may be controlled by an actuator 36, such as a pneumatic ram. Operation of the actuator 36 may be controlled by a controller 35 that includes a programmed computer or other suitable arrangement of electronic circuitry. Thus, the controller 35 may receive input, such as signals indicating a sash opening size, the presence of a person at an opening of the enclosure 1, an emergency condition, or other information, and actively control the position of the restrictor element 32 to set a suitable flow of air being exhausted from the enclosure 1. The controller 35 may also receive input from a sensor 52, such as a potentiometer, that indicates the current position of the flow restrictor element 32. The controller 35 may also receive input from other sensors, such as pressure sensors 37 and 38. A pressure differential sensed by the sensors 37 and 38 may indicate unacceptably low flow through the damper, such as when a blower upstream of the damper has malfunctioned, or flow is unacceptably low in the conduit 2 for some other reason.

An alarm 4 may be coupled to the controller 35 and activate based on a position of the flow restrictor 32 that would produce a flow below a particular threshold value and/or a detected pressure differential by the sensors 37 and 38. The alarm 4 may determine the threshold value at which a low flow alarm is provided using a flow setpoint provided by the controller 35. For example, the alarm 4 may be arranged to provide a low flow indication whenever flow is at or below 80% of the setpoint value established by the controller 35. Thus, the alarm 4 may compare a detected flow (equivalent to a flow detected by the sensor 52, the pressure sensors 37 and 38, or other means) to a flow equal to a desired percentage of the setpoint established by the controller 35. If the detected flow is below the threshold value, the alarm 4 may be activated.

When the proper operation of the alarm 4 is to be verified, such as when the ventilation system 100 is to be certified at initial installation or at periodic certification checks thereafter, the verification device 5 may be used to set flow below or above the threshold value at which the alarm 4 should normally be activated. A user may provide input to the verification device 5 to test the alarm by any suitable means, such as a press button, touch screen, graphical user interface, voice command, wireless signal, etc. In this embodiment, the verification device 5 may include a solenoid-controlled air valve that exposes a portion of the cylinder on one side of the piston in the pneumatic ram actuator 26 to ambient pressure, thereby causing the actuator 36 to drive the restrictor element 32 to a more closed position. A mechanical stop in the actuator 36 or elsewhere in the linkage may cause the restrictor element 32 to rest at a position that establishes flow at a known value below or above the alarm threshold value. Accordingly, since the controller 35 has not changed the current setpoint value for flow, the alarm 4 may be activated if it is operating normally.

In another illustrative embodiment, the verification device 5 may itself include a controller that provides an override control signal to the actuator 36, thereby controlling the actuator 36 to position the flow restrictor 32 in such a way as to provide a flow below or above the threshold value. The verification device 5 may receive information from the sensor 52 regarding the restrictor element position for use in feedback control of the actuator 36. Similarly, the verification device 5 may receive information regarding the flow setpoint established by the controller 35 to determine the threshold value at which the alarm 4 would normally be activated, and then suitably adjust flow via control of the actuator 36 or otherwise to the threshold value.

In another illustrative embodiment, the alarm verification device 5 may provide a signal to the alarm that indicates a flow below or above a threshold level when, in fact, no change in flow may have been made. For example, the alarm verification device 5 may send a signal to the alarm in place of a signal output by the sensor 52 indicating a restrictor element position that sets flow below or above a threshold flow. Alternately, the alarm verification device 5 may change the way in which the alarm determines whether to activate, e.g., by adjusting the algorithm used by the alarm to determine when to activate.

It will also be understood that operation of the alarm may be verified for two or more different flow rate setpoints established by the controller 35. For example, alarm operation may be verified for a condition in which the flow setpoint is relatively high, such as when a sash is opened to its maximum size. The alarm operation may also be verified for lower flow setpoints, such as when the system is in a standby mode or the sash is fully closed. Once the alarm operation has been verified, the verification device 5 may shut down and the controller 35 may resume normal control of the actuator 36.

Although in the embodiments above the verification device 5 interacts with portions of the air flow control 3 to adjust flow to be below or above a threshold value, the verification device 5 may include its own damper or other flow restrictor, a conduit bypass, blower, or other flow control devices to adjust flow in the conduit to verify the proper operation of the alarm. Alternately, the verification device 5 may be fully integrated into the controller of the air flow control. Thus, the verification device 5 need not be an apparatus that is separate from the air flow control, but rather include portions of the air flow control 3 that may be operated in an alarm verification mode.

Having thus described several aspects of at least one embodiment of this invention, it is to be appreciated various alterations, modifications, and improvements will readily occur to those skilled in the art. Such alterations, modifications, and improvements are intended to be part of this disclosure, and are intended to be within the spirit and scope of the invention. Accordingly, the foregoing description and drawings are by way of example only.

What is claimed is:

1. A system for verifying operation of an alarm in a vented enclosure, comprising:

an enclosure from which gas may be exhausted;

a flow control device that controls a flow rate of gas removed from the enclosure;

an alarm that provides an indication when a flow rate of gas being removed from the enclosure is below or above a threshold flow rate; and an alarm verification device that, in response to user input to test operation of the alarm, causes a signal that the flow rate of gas being removed from the enclosure is below or above the threshold flow rate.

2. The system of claim 1, wherein the alarm verification device is used to adjust the flow rate to a known value below or above the threshold flow rate.

3. The system of claim 2, wherein the alarm verification device is used to adjust the flow rate to the known value without requiring manual measurement of a flow of gas removed from the enclosure.

4. The system of claim 2, wherein the alarm verification device is used to adjust the flow rate to the flow rate to the known value without requiring actual measurement of flow.

5. The system of claim 1, wherein the alarm verification device includes a display that indicates when the signal indicates the flow rate is below or above the threshold flow rate.

6. The system of claim 1, wherein the alarm verification device includes a damper adjustment mechanism that adjusts a position of a restrictor element in a duct to control flow of gas exhausted from the enclosure.

7. The system of claim 6, wherein the alarm verification device includes a sensor that detects a position of the restrictor element in the duct.

8. The system of claim 1, wherein the alarm verification device outputs a signal that overrides normal control of the airflow control device and causes the air flow control device to set the flow rate to a known value below or above the threshold flow rate.

9. The system of claim 8, wherein the air flow control device includes a damper having a movable restrictor element and an actuator that causes movement of the restrictor element to adjust flow through the damper, and wherein the signal output by the verification device overrides normal control of the actuator.

10. The system of claim 1, wherein the alarm is activated based on a signal indicating a position of a damper in the air flow control device.

11. The system of claim 1, wherein the alarm is activated based on one of a measured pressure differential and a detection of actual flow of gas being removed from the enclosure.

12. An apparatus for verifying operation of an alarm in a vented enclosure, comprising:

a flow control device adapted to control a flow rate of gas flowing through a conduit from a vented enclosure; and an alarm verification device adapted to cause, in response to input from a user to test an alarm, generation of a signal that indicates the flow rate through the conduit is at a known value less than or greater than the threshold flow rate, the signal causing the alarm to be activated when operating normally.

13. The apparatus of claim 12, wherein the alarm verification device adjusts the flow rate to the known value that is below or above the threshold flow rate.

14. The apparatus of claim 12, wherein the alarm verification device is used to adjust the flow rate to the known value without requiring manual measurement of a flow of gas removed from the enclosure.

15. The apparatus of claim 12, wherein the alarm verification device is used to adjust the flow rate to the known value without requiring actual measurement of flow.

16. The apparatus of claim 12, wherein the alarm verification device includes a display that indicates when the flow rate is indicated to be at the known value below or above the threshold flow rate.

17. The apparatus of claim 12, wherein the alarm verification device includes a damper adjustment mechanism that adjusts a position of a restrictor element in a duct to control flow of gas exhausted from the enclosure.

18. The apparatus of claim 17, wherein the alarm verification device includes a sensor that detects a position of the restrictor element in the duct.

19. The apparatus of claim 12, wherein the alarm verification device outputs a signal that overrides normal control of the flow control device and causes the flow control device to set the flow rate below or above the threshold flow rate.

20. The apparatus of claim 19, wherein the flow control device includes a damper having a movable restrictor element and an actuator that causes movement of the restrictor element to adjust flow through the damper, and wherein the signal output by the verification device overrides normal control of the actuator.

21. The apparatus of claim 12, wherein the alarm is activated based on a position of a damper in the flow control device.

22. The apparatus of claim 12, wherein the alarm is activated based on one of a measured pressure differential and a detection of actual flow of gas being removed from the enclosure.

23. An air flow control apparatus, comprising:

a damper element movable in a conduit to adjust a flow of gas through the conduit;

a controller arranged to control a position of the damper element to maintain flow through the conduit at a setpoint value; and an alarm verification device arranged to override control of the damper position by the controller and position the damper element to set air flow through the conduit at a known value that is less than or greater than a threshold value, flow less than or greater than the threshold value being less than or greater than the setpoint and causing an alarm to be activated.

24. The apparatus of claim 23, wherein the alarm verification device adjusts the air flow to the known value without requiring actual measurement of flow.

25. The apparatus of claim 23, wherein the alarm verification device adjusts the flow rate to the known value without requiring manual measurement of the air flow.

26. The apparatus of claim 23, wherein the alarm verification device includes a display that indicates when the air flow is established at the known value.

27. The apparatus of claim 23, wherein the alarm verification device includes a damper adjustment mechanism that adjusts a position of the damper element to control the air flow.

28. The apparatus of claim 27, wherein the alarm verification device includes a sensor that detects a position of the damper element.

29. The apparatus of claim 23, wherein the alarm verification device outputs a signal that overrides normal control of the damper element by the controller and causes the air flow to be set at the known value.

30. The apparatus of claim 29, wherein the controller includes an actuator that causes movement of the damper element to adjust flow through the conduit, and wherein the signal output by the verification device overrides normal control of the actuator.

31. The apparatus of claim 23, wherein the alarm is activated based on a position of the damper element.

32. The apparatus of claim 23, wherein the alarm is activated based on a measured pressure differential.

33. The apparatus of claim 23, wherein the alarm is activated based on a detection of actual flow of air in the conduit.

34. A method for verifying the operation of an alarm for a vented enclosure, comprising:

providing an enclosure from which gas may be exhausted;

providing an air flow control device that normally controls a flow rate of gas removed from the enclosure to a setpoint value;

providing an alarm that provides an indication when a flow rate of gas being removed from the enclosure is below or above a threshold flow rate; and adjusting a flow rate of gas being removed from the enclosure to a known value below or above a threshold flow rate without manually measuring air flow to test the alarm.

* * * * *